US009637303B1

(12) United States Patent
Manning et al.

(10) Patent No.: US 9,637,303 B1
(45) Date of Patent: May 2, 2017

(54) VEHICLE TIRE TOTE STRUCTURE, AND METHODS OF USE AND MANUFACTURE THEREOF

(71) Applicant: Honda Motor Co., Ltd., Tokyo (JP)

(72) Inventors: John H. Manning, Columbus, OH (US); S. Robert Egbert, II, Anna, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/178,462

(22) Filed: Jun. 9, 2016

(51) Int. Cl.

| | |
|---|---|
| ***B65D 85/06*** | (2006.01) |
| ***A45C 11/24*** | (2006.01) |
| ***A45C 13/00*** | (2006.01) |
| ***A45C 13/10*** | (2006.01) |
| ***A45C 13/26*** | (2006.01) |
| ***A45C 13/30*** | (2006.01) |
| ***A45C 13/02*** | (2006.01) |

(52) U.S. Cl.
CPC ..... *B65D 85/06* (2013.01); *A45C 11/24* (2013.01); *A45C 13/005* (2013.01); *A45C 13/02* (2013.01); *A45C 13/103* (2013.01); *A45C 13/26* (2013.01); *A45C 13/30* (2013.01)

(58) Field of Classification Search
USPC ..... 206/304, 304.1, 304.2; 493/186, 210
See application file for complete search history.

(56) References Cited

U.S. PATENT DOCUMENTS

| | | | | |
|---|---|---|---|---|
| 1,013,564 A | | 1/1912 | Pratzner | |
| 1,018,185 A | | 2/1912 | Grimm | |
| 1,594,710 A | | 8/1926 | Buffington et al. | |
| 1,827,095 A | | 10/1931 | McCormick | |
| 1,889,776 A | | 12/1932 | Russell | |
| 1,947,145 A | | 2/1934 | Zerk | |
| 3,305,903 A | * | 2/1967 | McMahon | B60C 25/14 157/1.21 |

(Continued)

FOREIGN PATENT DOCUMENTS

| | | |
|---|---|---|
| CA | 2473699 A1 | 1/2006 |
| CA | 2806542 A1 | 8/2014 |
| WO | 2005016785 A1 | 2/2005 |

OTHER PUBLICATIONS

Oxford Spare Wheel Cover [online]; Retrieved from the Internet on Oct. 26, 2015; URL: http://www.alibaba.com/product-detail/oxford-spare-wheel-cover-polyester-tire_567148245.html.

(Continued)

*Primary Examiner* — Jacob K Ackun
(74) *Attorney, Agent, or Firm* — Kenealy Vaidya LLP

(57) ABSTRACT

Some embodiments are directed to a tire tote for at least one of a tire and a wheel. The tire tote can include a shell configured to surround the tire or wheel. The shell can include a central shell portion having at least one slit and being configured to extend around an annular wall of the at least one of the tire or wheel. The shell can also include a pair of side shell portions attached to the central shell portion, the pair of side shell portions configured to cover opposing faces of the at least one of the tire or wheel. The tire tote can further include a support strap inside the shell extending along a circumferential direction of the central shell portion. The tire tote may include a handle disposed outside the shell and attached to the support strap through the at least one slit.

20 Claims, 5 Drawing Sheets

(56) References Cited

U.S. PATENT DOCUMENTS

| | | | | |
|---|---|---|---|---|
| 4,126,169 | A | 11/1978 | Magnuson et al. | |
| 4,932,573 | A * | 6/1990 | Flint | B62D 43/005 206/304.1 |
| 6,116,415 | A * | 9/2000 | Rastelli | B60C 25/00 206/304.1 |
| 6,142,192 | A * | 11/2000 | Dickinson | B60C 25/147 141/114 |
| 7,478,723 | B2 | 1/2009 | Spater et al. | |
| 2012/0048897 | A1 * | 3/2012 | Fowler | B62D 43/005 224/42.2 |

OTHER PUBLICATIONS

Waterproof tire bag [online]; Retrieved from the Internet on Oct. 26, 2015; URL: http://www.weiku.com/products-image/9640799/waterproof-tire-bag.html.

* cited by examiner

VEHICLE TIRE TOTE STRUCTURE, AND METHODS OF USE AND MANUFACTURE THEREOF

BACKGROUND

The disclosed subject matter is directed to a vehicle tire tote structure, and methods of use and manufacture thereof. More particularly, the disclosed subject matter is directed to methods and apparatus for enhancing load carrying abilities, and providing increased flexibility in shell material choice.

Vehicle tires, and in some cases wheels having tires installed thereon, can be removable from a vehicle and stored or transported. These tires and wheels can be relatively heavy and cumbersome to store and transport, and may also have substances such as dirt, oil, brake dust, etc. disposed thereon. Forming a carrying bag or case into which tires or wheels can be stored and transported may therefore be beneficial for various reasons, such as to facilitate easier transportation of tires or wheels while protecting the tires or wheels and preventing spreading of substances disposed thereon.

SUMMARY

However, various structural considerations may make it challenging to effectively store and transport tires and wheels. For example, structural considerations may make it beneficial to utilize certain materials for both covering and supporting tires or wheels during storage and/or transportation. These materials can have advantageous characteristics such as being waterproof, flame retardant, lightweight, etc. These materials used to both cover and support tires or wheels therein may consequently sacrifice structural integrity to improve certain characteristics such as those described above. For instance, shell material is not generally suited to carrying a load required to move, lift, and carry a tire or wheel by a handle. As a result, load-carrying shell material of a carrying bag or case can experience poor fit with a tire or wheel, as well as stretching, tearing, etc.

It may therefore be beneficial to provide a vehicle tire tote structure, and methods of use and manufacture thereof, that address at least one of the above and/or other challenges of related art structures. In particular, it may be beneficial to enhance load carrying abilities, such as by providing reinforcement straps to carry a load of a tire or wheel without experiencing poor fit, stretching, tearing, etc. For example, dedicated support straps can be wrapped around a tire or wheel and have a handle attached thereto for improved lifting and transporting of the tire or wheel.

In some of these and/or other embodiments, the vehicle tire tote structure can be configured to include a webbing strap configured to wrap around a tire or wheel to carry a load thereof, the webbing strap having a handle attached thereto. In some of these and/or other embodiments, the tire tote can include a shell extending around both the tire or wheel and webbing strap to serve as a cover and protect while preventing spreading of substances, the shell merely wrapped around the tire or wheel without carrying the load and the handle extending therethrough. In some of these and/or other embodiments, the lining assembly can be configured to have zippers extending around faces of the shell to provide improved access to the tire or wheel disposed within the tire tote.

Some embodiments are therefore directed to a tire tote for storing and transporting at least one of a tire and a wheel of a vehicle within an interior thereof, the at least one of the tire and the wheel being separated from the vehicle and having a pair of opposing faces joined by an annular wall. The tire tote can include a shell configured to surround the at least one of the tire and the wheel. The shell can further include a central shell portion configured to extend around the annular wall of the at least one of the tire and the wheel, the central shell portion having at least one slit. The shell can further also include a pair of side shell portions attached to opposing sides of the central shell portion, the pair of side shell portions configured to cover the pair of opposing faces of the at least one of the tire and the wheel. The tire tote can also include a support strap disposed inside the shell extending along a circumferential direction of the central shell portion. The tire tote can additionally include a handle disposed outside the shell, the handle being attached to the support strap through the at least one slit in the central shell portion.

Some other embodiments are directed to a tire tote for storing and transporting at least one of a tire and a wheel of a vehicle, the at least one of the tire and the wheel being separated from the vehicle and having a pair of opposing faces joined by an annular wall. The tire tote can include a shell configured to surround the at least one of the tire and the wheel. The shell can further include an annular central shell portion defining an interior, the central shell portion having at least one slit. The shell can further also include a pair of side shell portions attached to opposing sides of the central shell portion, the pair of side shell portions configured to cover the pair of opposing faces of the at least one of the tire and the wheel. The tire tote can also include a liner disposed inside the shell, the liner being annular and extending along the interior of the central shell portion in a circumferential direction and configured to cover the annular wall of the at least one of the tire and the wheel. The tire tote can additionally include a support strap extending along the circumferential direction within the liner. Furthermore, the tire tote can have a handle disposed outside the shell, the handle being attached to the support strap through the at least one slit in the central shell portion.

Still other embodiments are directed to a method of forming a tire tote for storing and transporting at least one of a tire and a wheel of a vehicle, the at least one of the tire and the wheel being separated from the vehicle and having a pair of opposing faces joined by an annular wall. The method can include: providing a shell configured to surround the at least one of the tire and the wheel that includes an annular central shell portion defining an interior, the central shell portion having at least one slit, and a pair of side shell portions attached to opposing sides of the central shell portion, the pair of side shell portions configured to cover the pair of opposing faces of the at least one of the tire and the wheel; positioning a liner inside the shell, the liner being annular and extending along the interior of the central shell portion in a circumferential direction and configured to cover the annular wall of the at least one of the tire and the wheel; arranging a support strap to extend along the circumferential direction within the liner; and attaching a handle to the support strap through the at least one slit in the central shell portion, the handle being disposed outside the shell.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

Certain embodiments of a tire tote 10 are disclosed below, and FIGS. 1-5 illustrate some of these embodiments. However, embodiments are intended to include or otherwise cover many different embodiments and structures for improving storage and transportation of tires.

The embodiments are disclosed below in the context of a tire tote of an automobile. However, the embodiments are intended to be applicable to tire and wheel combination totes.

Various headings are provided below for convenience and clarity. However, these headings are not intended to limit the scope or content of the disclosure, and/or the scope of protection afforded the various inventive concepts disclosed herein.

I. Overall Tote Structure

Figure 1:
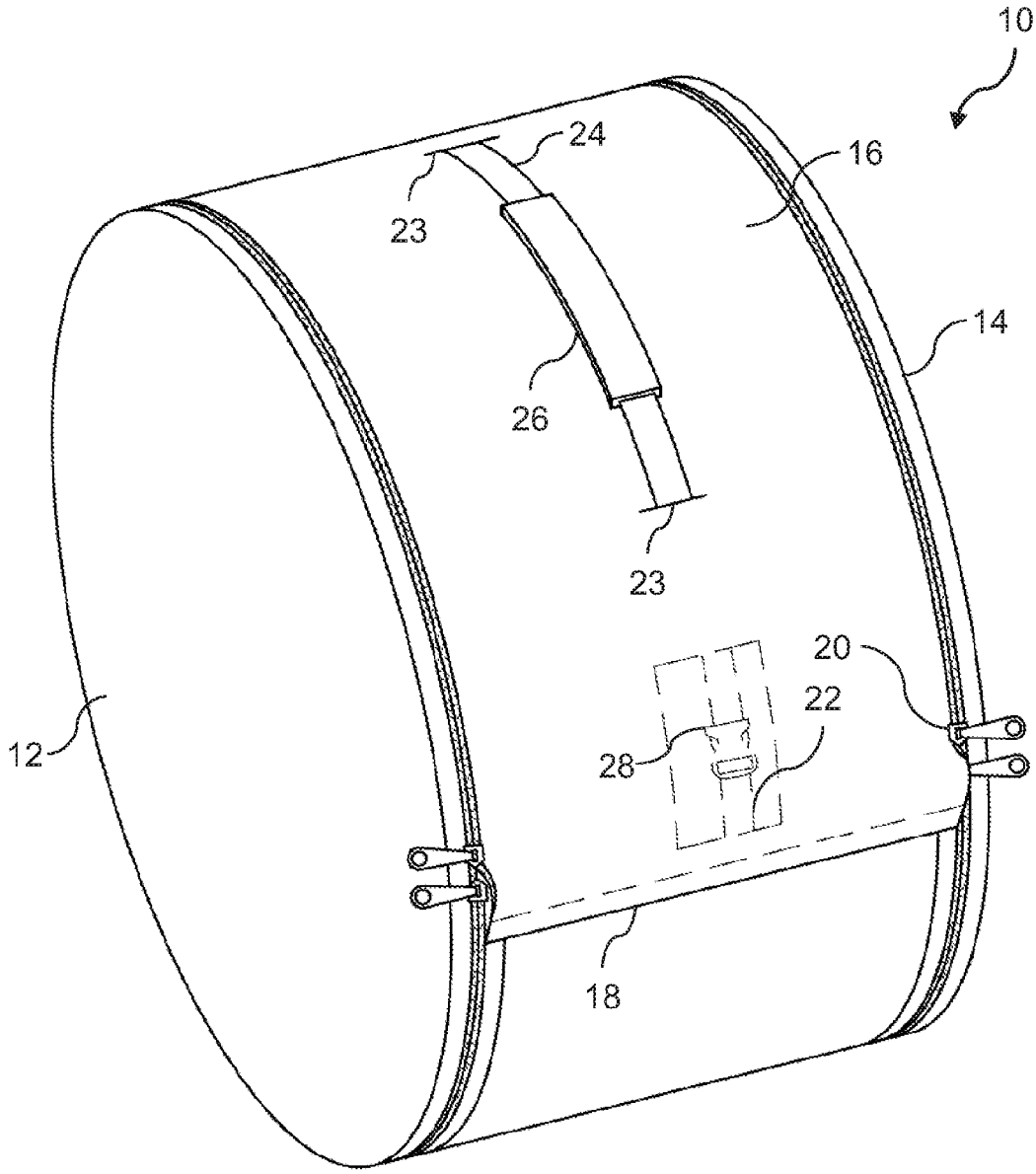
FIGS. 1 and 2 are perspective views of an exemplary tire tote in accordance with the disclosed subject matter.
Figure 2:
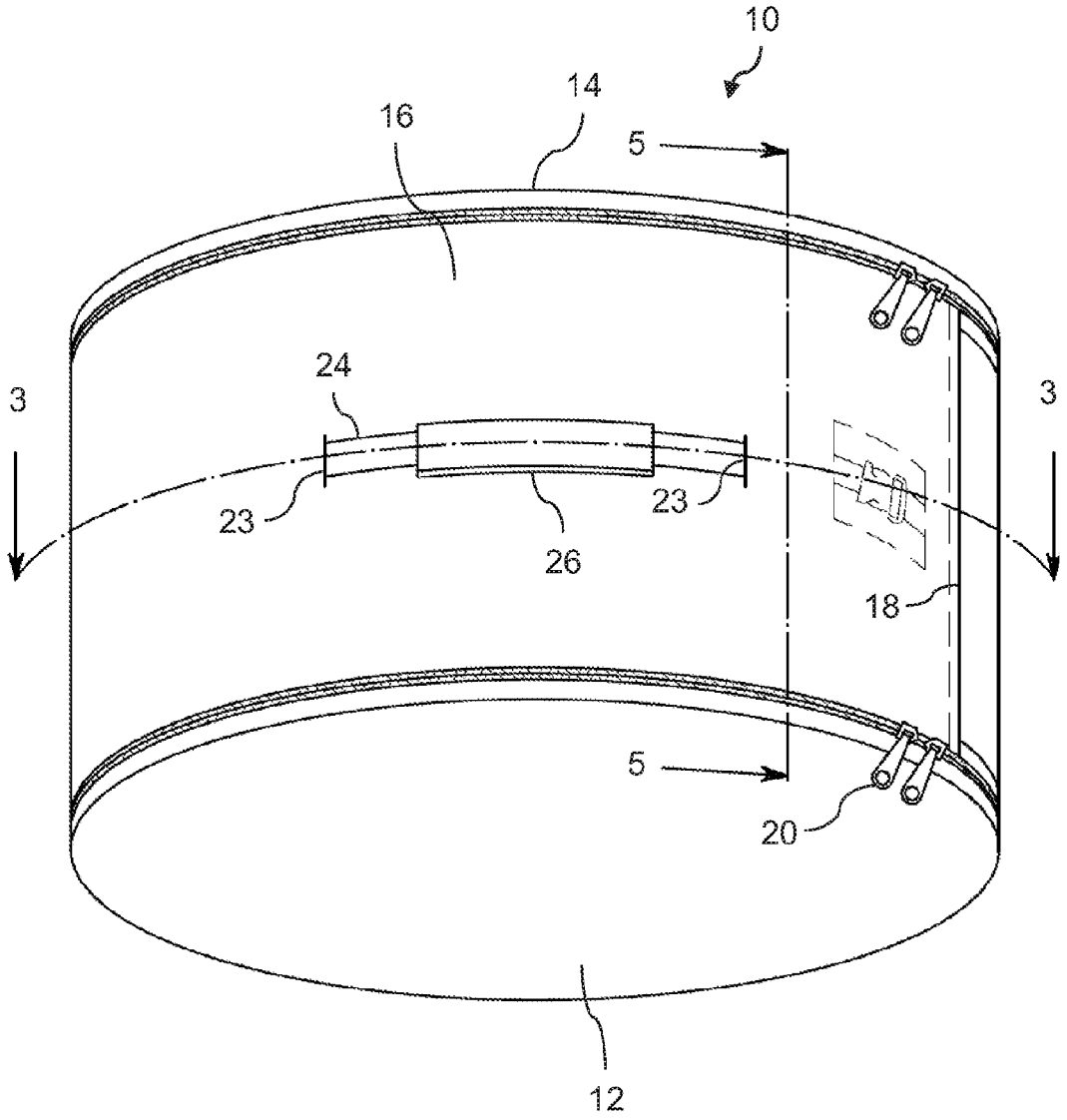

FIGS. 1 and 2 are perspective views of an exemplary tire tote 10 in accordance with the disclosed subject matter. The tire tote 10 of the present embodiment can be configured as approximately tire or wheel-shaped to accommodate a tire therein. In other words, the tire tote 10 can be cylindrical with front and back faces connected by a side panel. Additionally, a tire installed onto a wheel forming a wheel and tire combination can be accommodated within the tire tote 10.

Figure 3:
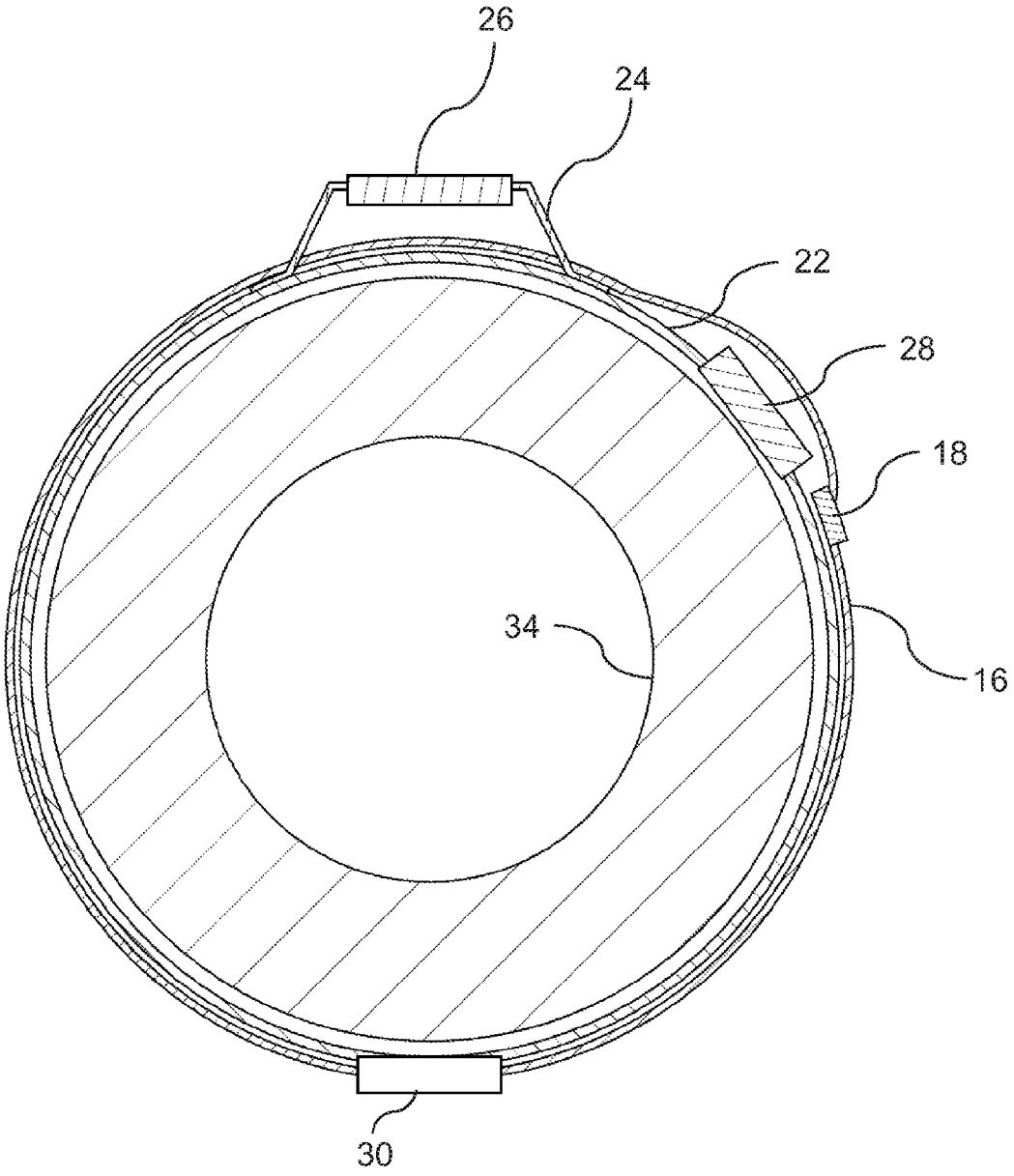
FIGS. 3 and 4 are cross-section views of the tire tote of FIG. 2.
Figure 4:
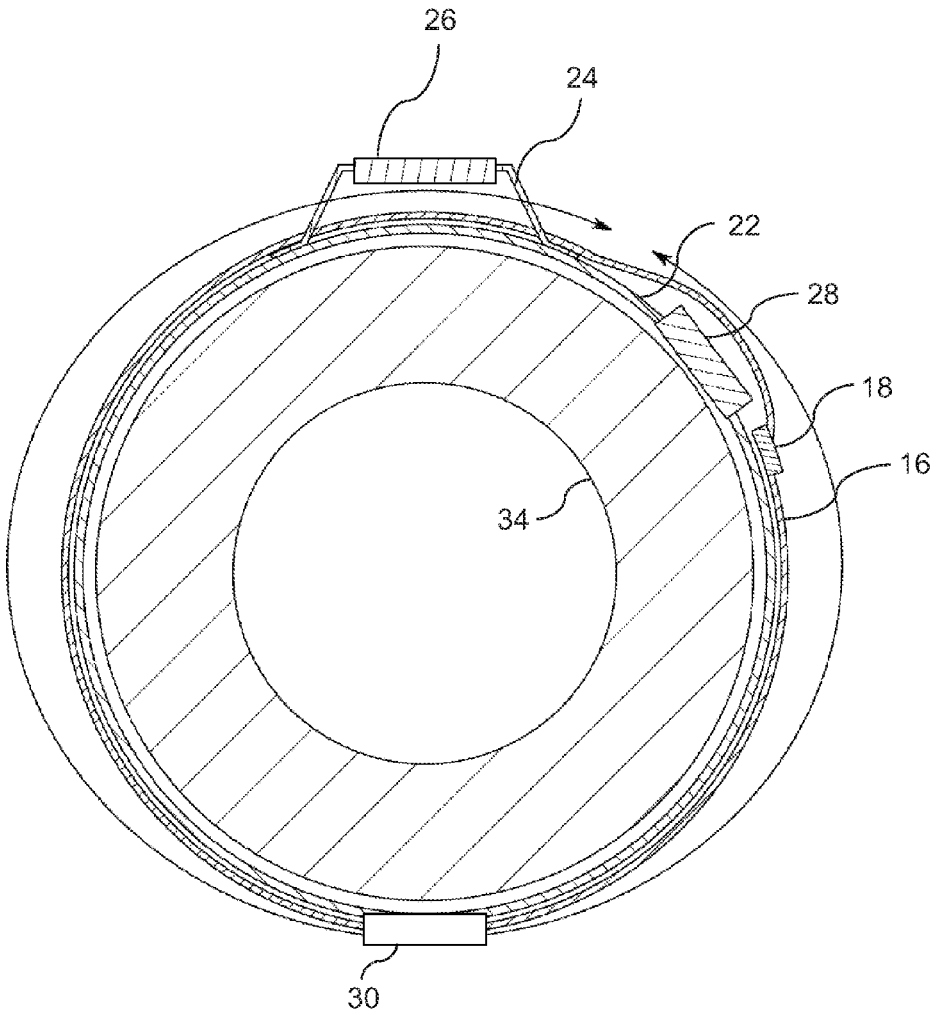

The tire tote 10 can include a front panel 12 and a back panel 14 configured as front and back faces, respectively, of a cylinder, connected by an outer shell 16 configured as a side wall. The front and back panels 12,14 can therefore be circular faces with the outer shell 16 extending therebetween to define an interior of the tire tote 10. The outer shell 16 can be formed as a single panel annularly wrapped around and having end portions that overlap at an attachment panel 18 to complete the side wall of the cylinder. The attachment panel 18 can be relatively wide or narrow, and the end portions of the outer shell 16 can be stitched together at the attachment panel 18 or connected in an alternate manner. For instance, the end portions of the outer shell 16 can alternatively be attached with clips, snaps, velcro or an adhesive to enable detachment of the end portions from one another. The outer shell 16 may then be detached for disassembly of the cover of the tire tote 10. Specifically, FIG. 4 displays arrows designating directions that portions of the outer shell 16 can be folded around to form the side wall or barrel of the tire tote 10 before being joined at the attachment panel 18. In the present embodiment, the front and back panels 12,14 can be connected to opposing sides of the outer shell 16 by zippers 20, specifically double zippers. However, other embodiments may include different forms of attachment between the front and back panels 12,14 and the outer shell 16. As shown in FIGS. 3 and 4 and described below, the front and back panels 12,14 can each be further connected to the outer shell 16 by hinge panels 30 disposed at a bottom portion of the outer shell 16.

In this configuration, the zippers 20 can unzip the front and back panels 12,14 to the hinge panels 30 at the bottom portion of the outer shell 16. Thus, the zippers 20 each extend annularly from a side of the respective hinge panel 30 around a perimeter of the front panel 12 or the back panel 14 to an opposing side of the respective hinge panel 30. When unzipped, the front panel 12 and the back panel 14 attached to the outer shell 16 at the respective hinge panels 30, and the front and back panels 12,14 may thus fold away from the outer shell 16 to reveal the interior of the tire tote 10. Once the interior of the tire tote 10 has been revealed through unzipping and opening the front panel 12 and/or the back panel 14, a tire or wheel and tire combination can be placed therein. Then, the zippers 20 extending along the unzipped and opened front panel 12 and/or back panel 14 can be zipped back up against the outer shell 16 to enclose the tire or wheel and tire combination within the tire tote 10.

In the present embodiment, the zippers 20 can be configured to extend from the respective panels 30 to the attachment panel 18, as shown in FIGS. 1 and 2. Each of the zippers 20 can thereby extend to the overlapping end portion of the outer shell 16 on one side, and to a corresponding underlapping end portion of the outer shell 16 on another side. Thus, opposing sides of each of the zippers 20 can be configured to meet at the attachment panel 18 when the front panel 12 and/or the back panel 14 are zipped up and attached to the outer shell 16. The overlapping portion of the outer shell 16 at the attachment panel 18 may therefore be configured without zippers extending along edges thereof.

Together, the front and back panels 12,14 and the outer shell 16 form a cover of the tire tote 10 to protect the tire or wheel and tire combination that may be disposed therein. Additionally, the front and back panels 12,14 and the outer shell 16 may impede or prevent substances on the tire or wheel and tire combination such as dirt, oil, dust, etc. from transferring onto other objects. Materials of the front and back panels 12,14 and the outer shell 16 comprising the cover of the tire tote 10 can be waterproof, flame retardant, or any other appropriate composition to achieve desired protection of the tire tote 10.

The tire tote 10 can also include a webbing strap 22 extending annularly along an inner surface of the outer shell 16, the webbing strap 22 configured as a structural, load carrying strap for supporting a weight of the tire or the wheel and tire combination that can be placed in the tire tote 10. The webbing strap 22 can have a relatively thin width compared to a width of the outer shell 16. Additionally, the webbing strap 22 can include a buckle 28 disposed thereon for clipping and unclipping the ends of the webbing strap 22 to and from one another. The buckle 22 can further include portion for adjusting a length of the webbing strap 22 so as to appropriately size the webbing strap 22 with regard to overall length. The buckle 28 can therefore also be covered by the outer shell 16. Adjusting the length of the webbing strap 22 allows tightening and loosening of the webbing strap 22 around the tire or the wheel and tire combination within the outer shell 16 of the cover. Tightening and loosening of the webbing strap 22 facilitates installment and removal of the tire or the wheel and tire combination into and out of the tire tote 10, as well as enhancing secure transportation of the tire or the wheel and tire combination once inside the tire tote 10.

The webbing strap 22 can be woven to allow stretch while remaining relatively taught around the tire or wheel and tire combination once placed inside the tire tote 10. The webbing strap 22 is included under the outer shell 16 to help support a weight of the tire or the wheel and tire combination. This prevents the outer shell 16 from stretching by carrying the load of the tire or wheel and tire combination.

Additionally, the webbing strap 22 can be stitched into a central portion of a liner 32, shown in more detail in FIG. 5 and described below, such that the liner 32 aligns the webbing strap 22 with a corresponding central portion of the outer shell 16. The liner 32 thereby extends annularly around the inside of the outer shell 16 so that the webbing strap 22 stitched into the central portion of the liner 32 also extends along the central portion inside the outer shell 16.

By distributing weight of the tire or wheel and tire combination along the webbing strap, the front and back panels 12,14 and the outer shell 16 comprising the cover does not bear the load. Thus, the cover of the tire tote 10 can be formed of materials aimed at achieving effects other than structural support for the load of the tire or wheel and tire combination.

The tire tote 10 of the present embodiment can include a handle strap 24 having an intermediate portion and ends attached to the webbing strap 22, the handle strap 24 being independent from the webbing strap 22 such that it is not directly wrapped around the tire or wheel and tire combination. As shown in more detail in FIGS. 3 and 4 and described below, the ends of the handle strap 24 can therefore be stitched or otherwise attached to the webbing strap 22 such that the intermediate portion extends away from the webbing strap 22. Furthermore, the ends of the handle strap 24 each be proximate a slit 23 in the outer shell 16 such that the intermediate portion of the handle strap 24 is disposed outside the outer shell 16 with the ends extending through the corresponding slits 23. The ends of the handle strap 24 can thereby be attached to the webbing strap 22 extending along the inside of the outer shell 16 while the intermediate portion of the handle strap 24 is outside the outer shell 16. In this configuration, the handle strap 24 serves to maintain desirable hand clearance for picking up and transporting the tire tote 10 without significantly altering or compromising tightness of the webbing strap 22 around the tire or wheel and tire combination. Thus, transportation of the tire tote 10 can be achieved through use of the handle strap 24 while keeping the tire or wheel and tire combination secure within the tire tote 10, and specifically the webbing strap 22.

The handle strap 24 of the present embodiment can additionally include a grip 26. The grip 26 can be disposed along the intermediate portion of the handle strap 24 outside the outer shell 16 so as to be accessible for picking up or transporting the tire tote 10. The grip 26 can be formed of rubber or a similarly appropriate material for grabbing and lifting the weight of the tire or wheel and tire combination. The grip 26 can also be shaped and contoured for improved ergonomics.

II. Webbing Strap and Cover Configuration

FIGS. 3 and 4 are cross-section views of the tire tote 10 of FIG. 2. As shown in FIGS. 3 and 4, the cover including the outer shell 16 is the outermost layer of the tire tote 10, while the webbing strap 22 is configured as an inner layer adjacent a tire or wheel and tire combination that can be placed within the tire tote 10.

Layers of the tire tote 10 including the cover, specifically the outer shell 16, and the webbing strap 22 can be configured to be circular in cross-section so as to be fitted around a tire or wheel and tire combination once placed in the tire tote 10. As described above, the opposing ends of the webbing strap 22 can be connected by the buckle 28 inside the cover. In the present embodiment, the buckle 28 can be oriented proximate the overlapping end portions of the outer shell 16 comprising the attachment panel 18. Thus, a portion of the outer shell 16 adjacent the attachment panel 18 can cover the buckle 28.

FIGS. 3 and 4 also show the handle strap 24 attached to the webbing strap 22, the ends of the handle strap 24 extending through the slits 23 in the outer shell 16. Particularly, the ends of the handle strap 24 can be stitched to an outward facing surface of webbing strap 22 such that the ends are disposed between the webbing strap 22 and the outer shell 16. Portions of the ends of the handle strap 24 attached to the webbing strap 22 can be relatively short in length compared to an entire length of the handle strap 24. This in part enables the intermediate portion of the handle strap 24 to extend from the webbing strap 22 and surrounding outer shell 16 so as to create space between the outer shell 16 and the grip 26. Hand clearance is thereby enhanced between the grip 26 and the cover of the tire tote 10.

Also shown in FIGS. 3 and 4, the hinge panel(s) 30 connecting the front and back panels 12,14 to the outer shell 16 can be positioned approximately opposite the handle strap 24 so that the front and back panels 12,14 hinge and fold away from the handle strap 24. Thus, the zippers 20 of the front and back panels 12,14 extend from the one side of the respective hinge panel 30, around the perimeter of the front and back panels 12,14, to the other side of the respective hinge panel 30.

The tire 34 shown in FIGS. 3 and 4 represents an approximate shape and size of an object to be placed into the tire tote 10. However, as described above, a wheel having a tire installed thereon can also be placed into the tire tote 10. Additionally, tires and wheel and tire combinations of various sizes and shapes regarding tread patterns can be fit into the tire tote 10, adjusting the webbing strap 22 at the buckle 24 to accommodate a perimeter of the object.

Figure 5:
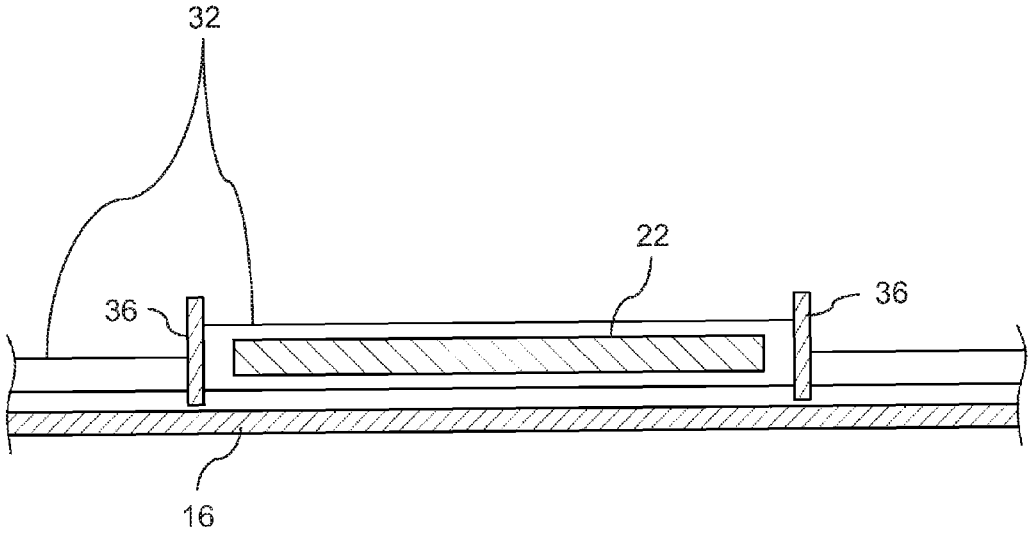
FIG. 5 is a cross-section view of an exemplary webbing strap of the tire tote of FIG. 2 in accordance with the disclosed subject matter.

FIG. 5 is a cross-section view of the exemplary webbing strap 22 of the tire tote 10 of FIG. 2 in accordance with the disclosed subject matter. In FIG. 5, the webbing strap 22 can be disposed within the liner 32, particularly the central portion of the liner 32, so as to keep the webbing strap 22 positioned along approximate centerlines of both the outer shell 16 and a tire or wheel and tire combination that may be placed within the tire tote 10. The liner 32 can have a width approximately equal to that of the outer shell 16 so that the liner 32 covers a significant amount of surface area of the tire or wheel and tire combination around which it can extend, specifically the barrel portion or tread portion of such. The liner 32 may thereby serve to properly orient the webbing strap 22 to adequately wrap around and support a tire or wheel and tire combination that may be placed within the tire tote 10.

Specifically, the webbing strap 22 can be disposed within a portion of the liner 32 having stitching 36 extending lengthwise along either side of the webbing strap 22. The stitching 36 can extend an entire length of the webbing strap 22, a majority length, or partial length. Furthermore, the webbing strap 22 may be held in approximately the central portion of the liner 32 in an alternate manner other than stitching. In embodiments including the liner 32, the liner 32 is spaced inward from the outer shell 16 such that the liner 32 corresponds to the webbing strap 22 layer of the tire tote 10.

III. Alternate Embodiments

While certain embodiments of the invention are described above, and FIGS. 1-5 disclose the best mode for practicing the various inventive aspects, it should be understood that the invention can be embodied and configured in many different ways without departing from the spirit and scope of the invention.

For example, embodiments are disclosed above in the context of the webbing strap 22 of the tire tote 10 shown in FIGS. 1-5. However, embodiments are intended to include or otherwise cover any type of carrying case or bag having a support strap disposed therein for enhancing transportation of vehicle tires and/or wheels having tires installed thereon, as disclosed above.

For example, exemplary embodiments are intended to include an outer shell 16 having a webbing strap 22 extending along an inside surface thereof for enhancing carrying strength of the tire tote 10 while enabling flexibility in choice of cover material. This webbing strap 22 can be can be relatively narrow and extend within the liner 32 such that the liner 32 covers a majority of a tire or wheel and tire combination placed within the tire tote 10 while the webbing strap 22 merely extends approximately along a centerline. This configuration of the webbing strap 22 and the liner 32 can ensure support and load carrying of the webbing strap 22 is transferred across a majority of the surface area of the tire or wheel and tire combination for improved load handling and stability. In another embodiment, the webbing strap 22 can extend around the inside surface of the outer shell 16 without the liner 32 such that the webbing strap 22 directly contacts a tire or wheel and tire combination placed therein. In another alternate embodiment, the webbing strap 22 can be widened to cover a majority of a width of the tire or wheel and tire combination around which the webbing strap 22 can be wrapped.

In fact, in some embodiments, the webbing strap 22 of the exemplary tire tote 10 can be anchored at various portions of the inside surface of the outer shell 16 such as extending through loops on the inside surface. Furthermore, covers such as the outer shell 16 may be omitted from the tire tote 10 to create a simpler and yet effective carrying bag or case for storing and transporting a tire or wheel and tire combination. As such, applications of the webbing strap 22 may not necessarily include all components of the above described tire tote 10 such as the outer shell 16 and front and back panels 12,14 while still providing a more secure structure through use of a dedicated load carrying strap. Thus, embodiments will also provide better usage/feeling to a user in accordance with the disclosed subject matter.

All or some of the alternative structures disclosed above with regard to the tire tote 10 also apply to applications beyond carrying bags or cases for tires and wheels. The above alternative configurations of the tire tote 10, and specifically the webbing strap 22, are merely provided for exemplary purposes, and as indicated above, embodiments are intended to cover any type of carrying bag or case having a support strap disposed therein that operate or otherwise perform as disclosed above. Embodiments are also intended to include or otherwise cover any alternative or additional carrying bags or cases that are structured and disposed to perform as disclosed above with regard to the webbing strap 22.

As disclosed above, embodiments are intended to be used with any type of tire or wheel having a tire installed thereon. The tire can be configured with tread for use on a paved road, or alternatively rugged terrain tread primarily for off-road use, and any hybrid use tread pattern as well. The tires and corresponding wheels can be of any size ranging from compact car tires to commercial equipment tires, with the carrying bag or case and support strap therein being sized appropriately to accommodate the tires.

Some configurations of the carrying bag or case can be configured such that multiple tires and/or wheels with tires can be placed and transported therein. Multiple tires or wheels can be stacked horizontally or vertically within a carrying bag or case depending on desirable configuration for storage and transportation.

Embodiments are also intended to include or otherwise cover methods of using and methods of manufacturing any or all of the elements disclosed above. The methods of manufacturing include or otherwise cover processors and computer programs implemented by processors used to design various elements of the vehicle tire tote structure disclosed above.

While the subject matter has been described in detail with reference to exemplary embodiments thereof, it will be apparent to one skilled in the art that various changes can be made, and equivalents employed, without departing from the scope of the invention. All related art references discussed in the above Background section are hereby incorporated by reference in their entirety.

What is claimed is:

1. A tire tote for storing and transporting at least one of a tire and a wheel of a vehicle within an interior thereof, the at least one of the tire and the wheel being separated from the vehicle and having a pair of opposing faces joined by an annular wall, the tire tote comprising:

a shell configured to surround the at least one of the tire and the wheel that includes:

a central shell portion configured to extend around the annular wall of the at least one of the tire and the wheel, the central shell portion having at least one slit; and a pair of side shell portions attached to opposing sides of the central shell portion, the pair of side shell portions configured to cover the pair of opposing faces of the at least one of the tire and the wheel;

a support strap disposed inside the shell extending along a circumferential direction of the central shell portion; and a handle disposed outside the shell, the handle being attached to the support strap through the at least one slit in the central shell portion.

2. The tire tote according to claim 1, wherein the support strap is an elongated strap having opposing ends annularly folded to attach to each other.

3. The tire tote according to claim 2, wherein the ends of the support strap are configured as complementary components of a buckle, the buckle being adjustable to increase or decrease an annular length of the support strap.

4. The tire tote according to claim 3, wherein the buckle is covered by the central shell portion.

5. The tire tote according to claim 1, wherein the support strap extends along an approximate centerline of the central shell portion in the circumferential direction.

6. The tire tote according to claim 1, wherein the central shell portion is an elongated panel having opposing ends annularly folded to overlap and attach to each other such that the panel becomes circular.

7. The tire tote according to claim 1, wherein the handle is an elongate strap having opposing ends, each of the ends extending through respective slits in the central shell portion and attached to the support strap, the handle being spaced from the central shell portion.

8. The tire tote according to claim 1, wherein the a pair of side shell portions are attached to opposing sides of the central shell portion by zippers such that the side shell portions can each be unzipped and removed to reveal the interior of the tire tote.

9. The tire tote according to claim 8, wherein the pair of side shell portions are hingedly connected to the central shell portion such that the zippers attaching each of the side shell portions to the central shell portion can be unzipped around respective hinges to allow the pair of side shell portions to fold away from the central shell portion.

10. The tire tote according to claim 9, wherein the respective hinges of the pair of side shell portions are disposed on the central shell portion approximately opposite the handle.

11. A tire tote for storing and transporting at least one of a tire and a wheel of a vehicle, the at least one of the tire and the wheel being separated from the vehicle and having a pair of opposing faces joined by an annular wall, the tire tote comprising:

a shell configured to surround the at least one of the tire and the wheel that includes:

an annular central shell portion defining an interior, the central shell portion having at least one slit; and a pair of side shell portions attached to opposing sides of the central shell portion, the pair of side shell portions configured to cover the pair of opposing faces of the at least one of the tire and the wheel;

a liner disposed inside the shell, the liner being annular and extending along the interior of the central shell portion in a circumferential direction and configured to cover the annular wall of the at least one of the tire and the wheel;

a support strap extending along the circumferential direction within the liner; and a handle disposed outside the shell, the handle being attached to the support strap through the at least one slit in the central shell portion.

12. The tire tote according to claim 11, wherein the support strap is an elongated strap having opposing ends annularly folded to attach to each other.

13. The tire tote according to claim 12, wherein the ends of the support strap are configured as complementary components of a buckle, the buckle being adjustable to increase or decrease an annular length of the support strap.

14. The tire tote according to claim 13, wherein the buckle is covered by the central shell portion.

15. The tire tote according to claim 11, wherein the support strap extends along an approximate centerline of the liner within which the support strap extends in the circumferential direction.

16. The tire tote according to claim 11, wherein the central shell portion is an elongated panel having opposing ends annularly folded to overlap and attach to each other such that the panel becomes circular.

17. The tire tote according to claim 11, wherein the handle is an elongate strap having opposing ends, each of the ends extending through respective slits in the central shell portion and attached to the support strap, the handle being spaced from the central shell portion.

18. The tire tote according to claim 11, wherein the a pair of side shell portions are attached to opposing sides of the central shell portion by zippers such that the side shell portions can each be unzipped and removed to reveal the interior of the tire tote.

19. The tire tote according to claim 18, wherein the pair of side shell portions are hingedly connected to the central shell portion such that the zippers attaching each of the side shell portions to the central shell portion can be unzipped around respective hinges to allow the pair of side shell portions to fold away from the central shell portion, the respective hinges of the pair of side shell portions being disposed on the central shell portion approximately opposite the handle.

20. A method of forming a tire tote for storing and transporting at least one of a tire and a wheel of a vehicle, the at least one of the tire and the wheel being separated from the vehicle and having a pair of opposing faces joined by an annular wall, the method comprising:

providing a shell configured to surround the at least one of the tire and the wheel that includes:

an annular central shell portion defining an interior, the central shell portion having at least one slit; and a pair of side shell portions attached to opposing sides of the central shell portion, the pair of side shell portions configured to cover the pair of opposing faces of the at least one of the tire and the wheel;

positioning a liner inside the shell, the liner being annular and extending along the interior of the central shell portion in a circumferential direction and configured to cover the annular wall of the at least one of the tire and the wheel;

arranging a support strap to extend along the circumferential direction within the liner; and attaching a handle to the support strap through the at least one slit in the central shell portion, the handle being disposed outside the shell.

* * * * *